United States Patent [19]

Ray et al.

[11] Patent Number: 4,748,603

[45] Date of Patent: May 31, 1988

[54] CHRONOGRAPH WATCH

[75] Inventors: Claude Ray, Canton of Neuchâtel; Michiel Groothuis, Canton of Berne, both of Switzerland

[73] Assignee: Conseilray S.A., Canton of Neuchâtel, Switzerland

[21] Appl. No.: 55,178

[22] Filed: May 28, 1987

[30] Foreign Application Priority Data

May 29, 1986 [CH] Switzerland ..... 2164/86

[51] Int. Cl.[4] ..... G04B 19/04; G04B 37/00

[52] U.S. Cl. ..... 368/80; 368/88; 368/223

[58] Field of Search ..... 368/76, 80, 88, 107–113, 368/276, 299–300

[56] References Cited

U.S. PATENT DOCUMENTS 4,623,261 11/1986 Muto ..... 368/80
4,659,233 4/1987 Nakamura et al. ..... 368/260

FOREIGN PATENT DOCUMENTS 0070052 1/1983 European Pat. Off. .
2940246 4/1981 Fed. Rep. of Germany .
3511009 10/1985 Fed. Rep. of Germany .
647125 1/1985 Switzerland .

*Primary Examiner*—Vit W. Miska
*Attorney, Agent, or Firm*—Silverman, Cass, Singer & Winburn, Ltd.

[57] ABSTRACT

The watch comprises a conventional timepiece movement driving the hours-hands, the minutes-hands and the seconds-hands, to which is added a chronograph module the frame of which, having the shape of a bell, covers the movement of the timepiece. The chronograph is autonomous, i.e. its indicators are not driven by the basis movement but by electric motors situated around the central movement, fed by a battery and piloted by a quartz oscillator, the frequency divisions being effected by an integrated circuit. The printed circuit associated with this whole comprises an annular plate surrounding the timepiece movement. An intermediary plate ensures the connection between the timepiece movement and the chronograph module. The transformation of a conventional timepiece movement into a chronograph watch is thus very easy, the chronograph module being able to be applied to very different timepiece movements, only the intermediary plate having to be different.

10 Claims, 2 Drawing Sheets

CHRONOGRAPH WATCH

BACKGROUND OF THE INVENTION (a) Field of the Invention

The present invention relates to a chronograph watch.

(b) Description of the Prior Art

One of the difficulties for the realization of chronograph watches lies in the fact that each timepiece movement or clockwork must be designated per se and that, due to the relatively restricted number of chronograph watches, their cost is thereby greatly increased.

The same way, the manufacturer who contemplates transforming an existing watch movement so as to adapt thereto a chronograph mechanism, generally associated with auxiliary indicators of minutes and of hours for instance, is obliged to adapt his construction to the type of clockwork or movement which he has chosen, whereby the study and the realization, especially the tooling, suit only one type and must be repeated for each type of movement which has to be equipped with the chronograph mechanism.

Here again, the cost is greatly increased thereby.

SUMMARY OF THE INVENTION

The object of the present invention is to furnish a means permitting to adapt easily a chronograph mechanism to a timepiece movement, the chronograph mechanism being able to be applied, without substantial modifications, to any clockwork or movement.

That permits the realization of chronograph modules in series production, since they are usable on many different clockworks for timepieces.

This object is achieved by the fact that the chronograph watch according to the present invention comprises, besides a timepiece movement driving the conventional time indicators, an autonomous chronograph movement comprising a source of energy, a timekeeper and at least one indicator, this chronograph movement comprising an annular frame surrounding the frame of the timepiece movement.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

The watch represented, generally designated by 1, comprises a conventional clockwork or movement 2, which is round in the present case, driving the conventional hands, i.e. an hour-hand 3, a minute-hand 4 and and a central seconds-hand 5.

Figure 1:
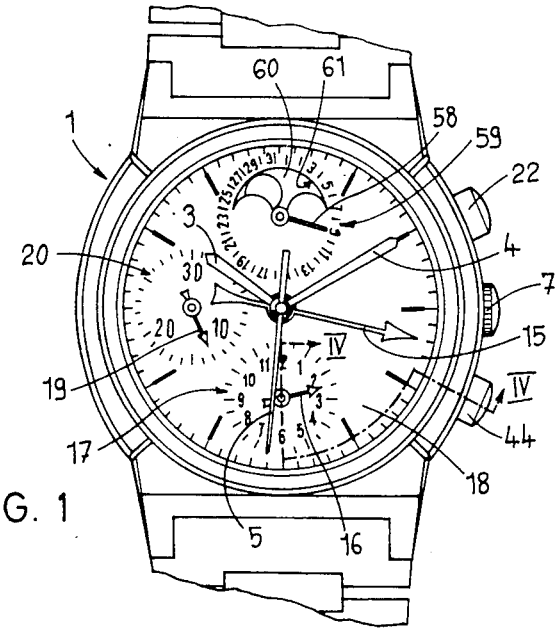
FIG. 1 is a plan view of a chronograph watch.

It is a conventional clockwork, mechanical or electronic, the winding and the resetting of which, respectively the resetting alone, are effected by means of a stem 6 (FIG. 3) carrying a control crown 7 (FIG. 1).

Figure 4:
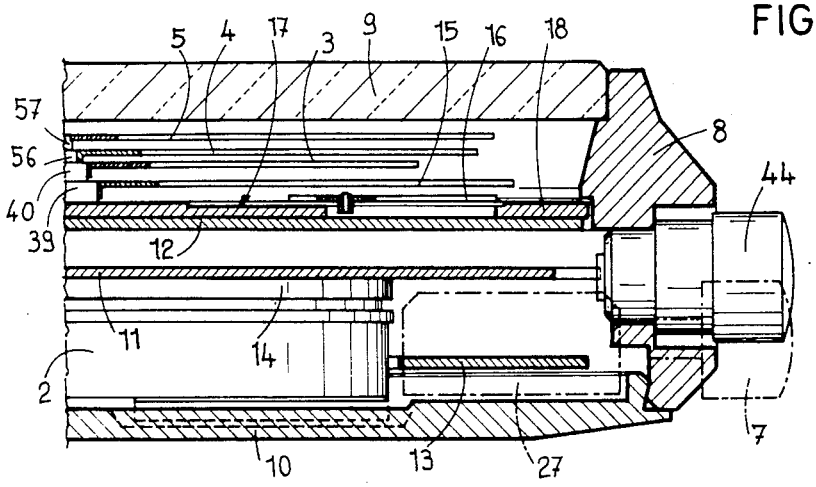
FIG. 4 is a sectional view of a detail of this watch, on the line IV—IV of FIG. 1, to a larger scale.

The casing of this watch comprises a casing body made of one piece with a bezel 8, a glass 9 and a bottom 10 (FIG. 4).

The watch 1 moreover comprises a chronograph mechanism carried by a frame in dependent from the frame of the timepiece movement 2. The frame of this chronograph movement or module is diagrammatically represented in FIG. 2 where have only been represented the plates of this frame, to the exclusion of the parts constituting distance pieces like pillars or columns.

This frame comprises a base-plate 11 and an upper plate 12 as well as an annular bridge 13 and has the general shape of a bell, which covers the clockwork or movement 2, the annular part of this frame surrounding the movement 2. An intermediary plate 14 which ensures the connection between the timepiece movement 2 and the chonograph module is interposed between them. The relief of its lower face will correspond to that of the plate of the timepiece movement 2. This way, only this intermediary plate 14 has to be modified for permitting to apply the chronograph module to any clockwork of any type.

The intermediary plate 14 to which is secured the base plate 11 of the frame of the chronograph module will be secured to the base-plate of the timepiece movement 2 in lieu of the dial thereof and by the same means, for instance by means of feet it will present to this effect. These feet can also serve to the positioning (centering, orientation) of the intermediary plate on the base-plate of the movement 2 only, the securing itself being effected by means of screws screwed in holes of the base-plate of the movement provided for the members which secure the movement in the casing. Then, it will be the base-plate 11 or 12 of the frame of the chronograph module which will carry the members securing the whole in the casing.

Figure 5:
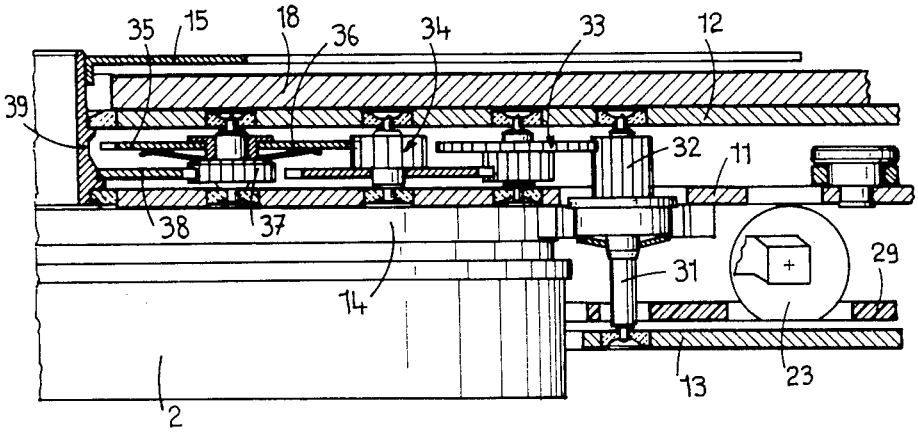
FIG. 5 is a sectional view on the line V—V of FIG. 3, to a larger scale.
Figure 6:
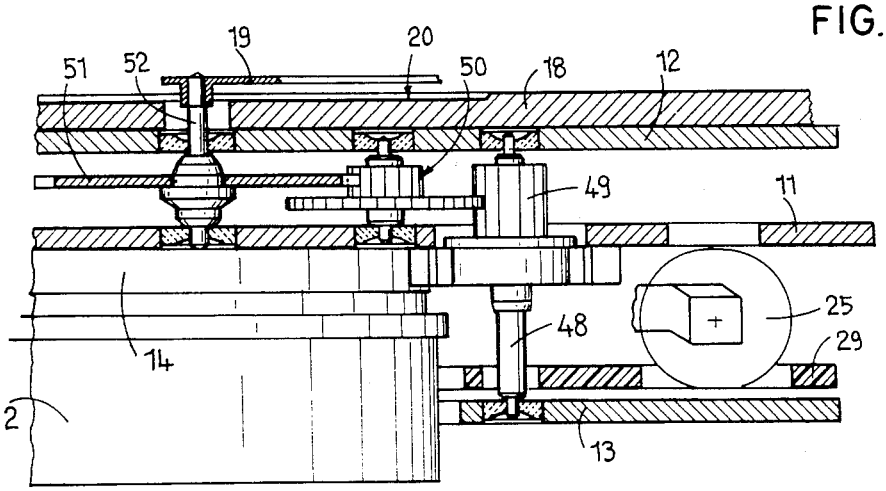
FIG. 6 is a sectional view on the line VI—VI of FIG. 3, also to a larger scale.

The chronograph module comprises three indicators, i.e. a chronograph center hand 15, advancing step by step at a rate of 1/5 of second at each step, a hand 16 counting the hours, rotating opposite a hours division 17 of the dial of the watch designated by 18, and a hand 19 for the counting of the minutes, rotating opposite a division 20 of minutes provided on the dial 18. This dial, appearing on the base-plate 12 (FIGS. 4, 5 and 6), is secured by means of feet 21 which are prolongated up to the level of the plates 11 or 12 (FIG. 3).

All these indicators, chronograph hand and counters, are driven per se, that is to say independently from the timepiece movement 2, the chronograph module, which is electric, being autonomous. Its running and its stopping are controlled by a pusher 22.

To this effect, the annular bridge 13 of the frame of the chronograph module carries three electric motors 23, 24 and 25 driving respectively the three hands 15, 16 and 19. These three motors 23, 24 and 25 are controlled by a quartz oscillator 26 and are fed by a common battery 27 (FIG. 3), the frequency divisions as desired being produced by an integrated circuit 28. The module comprises a printed circuit 29 the plate of which, which is annular, is superposed to the annular bridge of the frame of this module.

Figure 3:
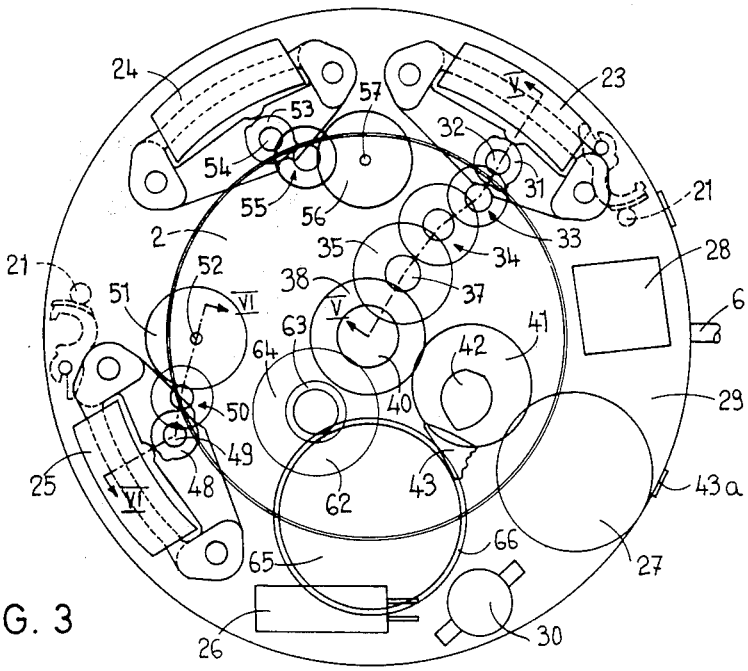
FIG. 3 is a plan view, from the bottom, of the watch movement of FIG. 1, to the scale of FIG. 2, a portion of the frame being eliminated.

This way, the three motors, the quartz oscillator, the battery, the integrated circuit with, moreover, a trimmer, indicated at 30 in FIG. 3, are all situated around the timepiece movement 2.

Figure 2:
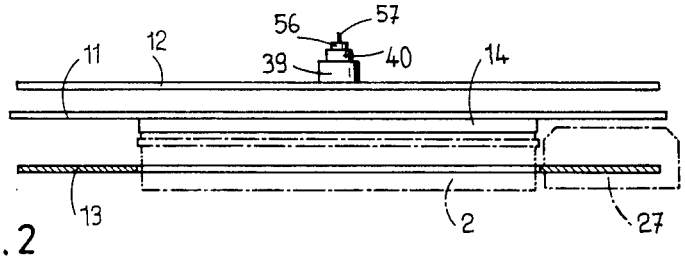
FIG. 2 is an elevational view, diagrammatically represented, with a partial section, and to a larger scale of the frame of the movement or chronograph module.

The chronograph-hand 15 is driven by the motor 23 as follows:

The rotor of the motor 23, designated by 31 (FIGS. 3 and 5) is rigid with a pinion 32 driving, through the intermediary of two wheels and pinions 33 and 34, a wheel 35 connected, through the intermediary of a friction coupling comprising a cumbered washer 36, to a pinion 37 meshing with a wheel 38 rigid with a sleeve or cannon 39 surrounding the cannon hour-wheel, designated by 40, of the timepiece movement 2 (FIGS. 2 and 4). This cannon 39 carries the chronograph hand 15. The whole gearing connecting the rotor of the motor 23 to the hand 15 is thus carried by the central part of the frame of the chronograph module, covering the timepiece movement 2, and not by the annular portion of this frame, surrounding the movement.

The friction between the wheel 35 and the pinion 37 has for purpose to permit the manual resetting to zero of the hand 15 without the rotor of the motor be sollicited.

In view of this resetting to zero, the wheel 33 rigid with the cannon 39 is meshing with a wheel 41 (FIG. 3) rigid with a resetting heart 42 with which cooperates a resetting hammer 43, a very short portion of which only has been represented in FIG. 3, controlled by a resetting pusher 44 acting on a portion 43*a*, which has been bent at right angle, of the lever which is provided with the hammer 43 (FIGS. 1 and 4). It is to be noted that the resetting of the hand 15 could not be made easily electronically, through the intermediary of the driving motor 23, due to the fact that, since this hand rotates step by step at rate of 1/5 of second at each step, the resetting operation would then be much too long. On the contrary, if the mechanism would be arranged in such a way that the hand 15 runs step by step by reason of steps of one second each, then an electronic resetting could be provided.

The hand 19 of the minutes counter is driven by the motor 25 as follows:

The rotor, designated by 48 (FIG. 6), of the motor 25 is rigid with a pinion 49 driving, through the intermediary of a wheel and pinion 50 a wheel 51 the shaft of which, designated by 52, carries the hand 19.

The hand 16 of the hours counter is driven by the motor 24 as follows:

The rotor, designated by 53 (FIG. 3), of the motor 24 is rigid with a pinion 54 driving, through the intermediary of a wheel and pinion 55, a wheel 56 the shaft of which, designated by 57, carries the hand 16. The resetting to zero of the hand 16 of the hours counter and 19 of the minutes counter will be effected electronically, controlled by the pusher 44. Thus, the resetting of the different chronograph indicators is mixed, the chronograph hand 15 being mechanically, resetted and the counters hands 16 and 19 being electronically resetted. It is to be noted that the resetting of the counters could also be effected mechanically, by means of hearts which would then be operated by hammers which could be constituted by supplementary panes of the same lever as the lever provided with the hammer 43.

The watch as disclosed and represented moreover comprises a date indicator constituted by a hand 58 rotating opposite a division of the dates 59 of the dial 18 and an indicator of the phases of the moon constituted by a disc 60 visible through a window 61 of the dial.

These two indicators are driven by the movement 2 from the hour cannon wheel 40 which drives a wheel 62 (FIG. 3) rigid with two pinions 63 and 64 meshing with two coaxial wheels 65 and 66, respectively. The wheel 62 and the wheels 65 and 66 are carried by the intermediary plate 14. The wheel 65 carries the hand 58 of the dates while the wheel 66 carries the disc 60 of the phases of the moon. The intermediary plate 14 could still carry other indicators.

It is to be noted that the term "annular" used for designating the special shape of the frame of the chronograph module does not imply that this frame be obligatorily circular. As a matter of fact, the basis movement of the timepiece could be of a shape other than round, the annular frame of the chronograph module being then of corresponding a shape so as to surround the timepiece movement.

Owing to the present arrangement, the basis movement 2 does not receive any other modifications, when being equipped with a chronograph, than the prolongation of the cannon 40 of the hour wheel, of the cannon pinion, designated by 67, carrying the hand 4 of the minutes, and of the stem 68 of the central seconds hand 5.

We claim:

1. A chronograph watch comprising a timepiece movement having a frame and driving a plurality of conventional time indicators including at least an hour and a minute indicator, an autonomous chronograph movement including a source of energy, a timekeeper and at least one indicator, said chronograph movement having an annular frame surrounding said frame of said timepiece movement.

2. A chronograph watch as claimed in claim 1, in which the frame of the chronograph movement is provided with a central portion extending above the timepiece movement.

3. A chronograph watch as claimed in claim 2, wherein said timepiece movement includes a plate and said chronograph movement frame includes a basis plate in which an intermediary plate is interposed between the plate of the timepiece movement and the basis plate of the frame of the chronograph movement, so as to produce a connection between these two plates.

4. A chronograph watch as claimed in claim 1, in which the chronograph movement is electronic and comprises at least one motor, an electric battery feeding this motor, a quartz oscillator and an electronic circuit controlling the motor piloted by the said oscillator, all these elements, carried by the frame of the chronograph movement, being distributed around the timepiece movement.

5. A chronograph watch as claimed in claim 4, in which the chronograph movement is provided with a central portion extending above the timepiece movement and in which the chronograph indicator is situated, in plan view, opposite the area occupied by the timepiece movement, its driving motor acting through the intermediary of a gearing carried at least partially by the central portion of the frame of the chronograph movement.

6. A chronograph watch as claimed in claim 5, in which the chronograph indicator is situated in the center of the watch.

7. A chronograph watch as claimed in claim 2, in which the chronograph movement comprises several indicators at least some of which are driven each by a respective motor.

8. A chronograph watch as claimed in claim 7, in which all the motors are fed by only one source of energy.

9. A chronograph watch as claimed in claim 7, in which the chronograph movement comprises a printed circuit the plate of which is annular and surrounds the timepiece movement.

10. A chronograph watch as claimed in claim 3, in which the said intermediary plate carries at least a part of the driving gearing of at least one supplementary time indicator driven by the timepiece movement.

* * * * *